US006441331B1

(12) United States Patent
Ni et al.

(10) Patent No.: US 6,441,331 B1
(45) Date of Patent: Aug. 27, 2002

(54) PRESS SWITCH

(75) Inventors: Yu-Ting Ni; Wen-Hsiang Lu; Hsin-Hsun Chen, all of Hsin-Tien (TW)

(73) Assignee: Shin Jiuh Corp., Hsin-Tien (TW)

( * ) Notice: Subject to any disclaimer, the term of this patent is extended or adjusted under 35 U.S.C. 154(b) by 103 days.

(21) Appl. No.: 09/740,997

(22) Filed: Dec. 21, 2000

(51) Int. Cl.[7] ..... H01H 13/14

(52) U.S. Cl. ..... 200/520; 200/534; 200/511; 200/406

(58) Field of Search ..... 200/520, 534, 200/535, 505, 510, 511, 406, 239, 16 R, 16 A, 341, 345, 243, 521

(56) References Cited

U.S. PATENT DOCUMENTS 3,590,331 A * 6/1971 Kirsch ..... 200/535
4,177,367 A * 12/1979 Tirone et al. ..... 200/535
4,385,218 A * 5/1983 Nishida ..... 200/1 B
4,463,233 A * 7/1984 Tanabe ..... 200/345
4,843,197 A * 6/1989 Kojima et al. ..... 200/302.2
4,894,498 A * 1/1990 Kagawa et al. ..... 200/284
5,199,556 A * 4/1993 Lee ..... 200/345
5,345,051 A * 9/1994 Miike ..... 200/341
5,726,400 A * 3/1998 Masuda ..... 200/1 R
5,895,901 A * 4/1999 Watanabe et al. ..... 200/530
6,049,047 A * 4/2000 Miyashima et al. ..... 200/16 A
6,271,487 B1 * 8/2001 Domzalski et al. ..... 200/1 B

* cited by examiner

*Primary Examiner*—Elvin Enad
*Assistant Examiner*—Kyung S. Lee
(74) *Attorney, Agent, or Firm*—Bacon & Thomas, PLLC

(57) ABSTRACT

An improved press switch for channeling signal transmission or output includes a body, two terminal element mounted on the body, a first elastic element located in the body, a press element disposed in the body above the first elastic element, and a face panel for covering the body at the front side thereof. When the press element subjects to an external pressing force, a second elastic element will be driven to press the first elastic element which in turn makes contact with the two terminals for establishing an electrical link to output electric characteristics desired. When the external pressing force is released from the press element, the innate elastic force of the first and second elastic element will push the press element to its original position.

7 Claims, 6 Drawing Sheets

PRESS SWITCH

BACKGROUND OF THE INVENTION

This invention relates to an improved press switch and particularly a press switch that has a simple structure for reducing impedance.

The generally known press switch for channeling or output signal is widely used in various electrical devices such as mobile phone, computer and computer peripheral devices. FIG. 1 shows the general construction of a conventional press switch which includes a body 6, a first elastic element 7 and a second elastic element 8 located in the body 1, a terminal member 9 located in the body 6 above the first and second elastic elements 7 and 8, and a press element 10 located above the terminal member 9. When the press element 10 subjects to an external pressing force, the notch 101 at the press element 10 will press against an elastic strip 91 located on the terminal member 9. The elastic strip 91 in turn will press against the first and second elastic element 7 and 8 whereby to enable the first elastic element 7 bridging and linking the conductive element 61 and 62 for transmitting signals.

Applicant has disclosed an improved tact switch structure in U.S. Pat. No. 6,140,596 which includes a seat body, a first elastic element, a press set, and a closure body. After the first elastic element and the press set have been assembled and disposed in the seat body, the closure body is then combined on the seat body. When an external force is exerted on the press set, the press set will drive the first elastic element to contact and conductively joint with a first and a second electrode.

The examples of the prior art set forth above are capable of channeling and output electric signal. However they all have their share of disadvantages. For instance in the first example, the first and second elastic element 7 and 8 do not have anchoring positions in the body 6. Hence when the elastic strip 91 presses the first and second elastic element 7 and 8, displacement of the first and second elastic element 7 and 8 will occur, and might result in poor or no connection between the conductive elements 61 and 62. Some producers try to remedy this problem by fastening the conductive element 61 to the body 6, and pre-connect them electrically with the first elastic element 7. When the first and second elastic element 7 and 8 are being pressed, as long as the first elastic element 7 making contact with the conductive element 62, electrical connection will be established for transmitting signal. The second example also has similar problem as the first example does. Both of aforesaid examples also have fabrication difficulties and problems, and will result in higher production cost.

Furthermore, as the first example has relative complex structure, it needs more time and process to assemble, and thus has higher production cost. In addition, the conductive element 61 and 62, and the first and second elastic element 7 and 8, and terminal member 9 are all made of metal. They have more contact points during contact, and will result in higher impedance and consequently cause signal fading.

SUMMARY OF THE INVENTION

In view of aforesaid disadvantages, it is therefore an object of this invention to provide an improved press switch that has a simple structure and may be assembled with less process and time for reducing production cost.

Another object of this invention is to provide a structure that has smaller number of contact points whereby to greatly reduce impedance so that transmitting signals won't be fading.

In order to achieve aforesaid objects, the press switch according to this invention includes a body, two terminal elements disposed in the body, a first elastic element located in the body, a press element located in the body above the first elastic element, and a face panel covering the body. When the press element subjects to an external pressing force, a second elastic element will be driven to press the first elastic element which in turn links the two terminals for output electric characteristics desired. When the press element is free from the external pressing force, the innate elastic force of the first and second elastic element will push the press element to its original position.

BRIEF DESCRIPTION OF THE DRAWINGS

The invention, as well as its many advantages, may be further understood by the following detailed description and drawings, in which.

DESCRIPTION OF THE PREFERRED EMBODIMENT

Figure 1:
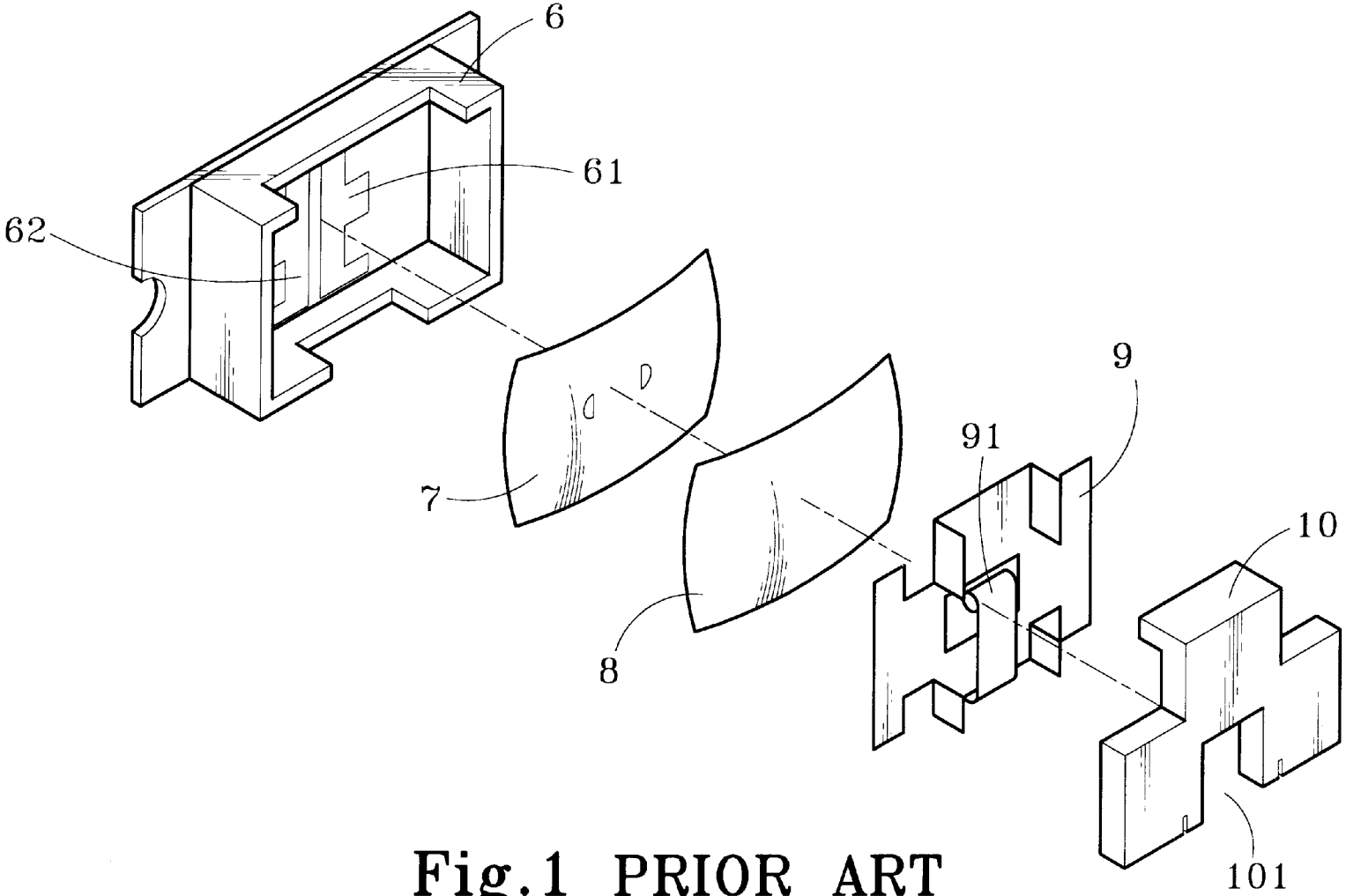
Fig.1 PRIOR ART
FIG. 1 is an exploded view of a conventional press switch.
Figure 2:
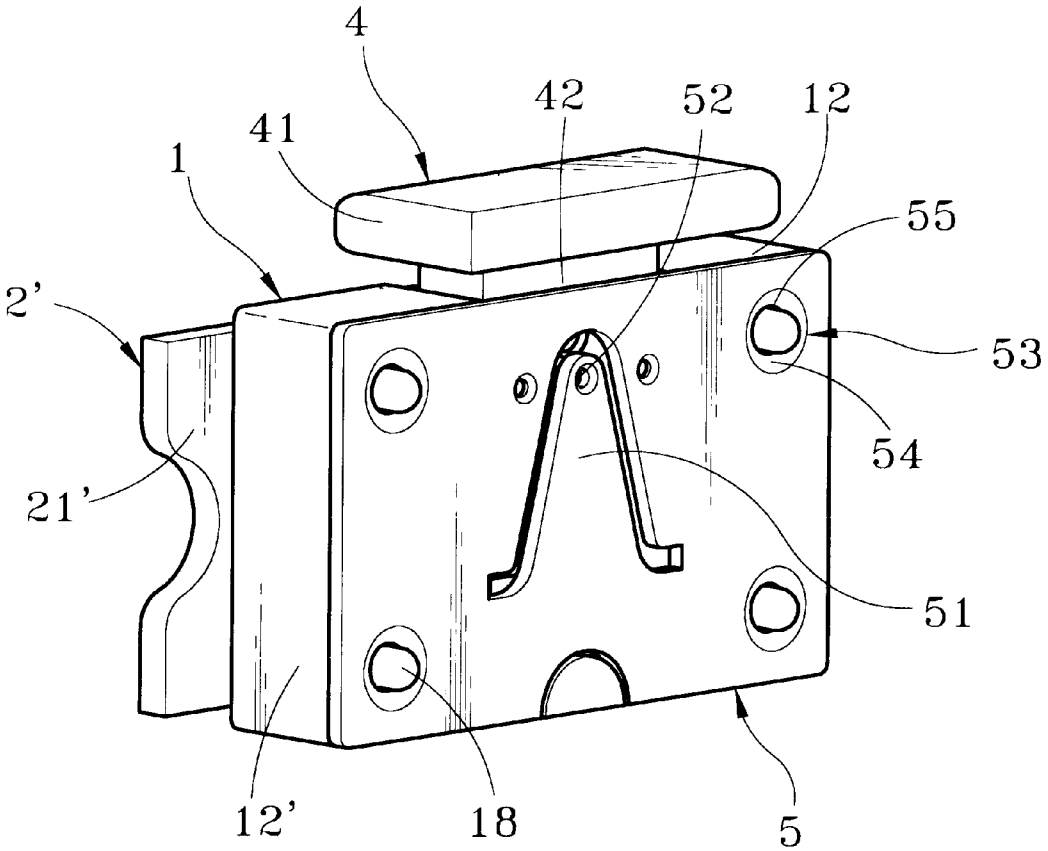
FIG. 2 is a perspective view of this invention.
Figure 3:
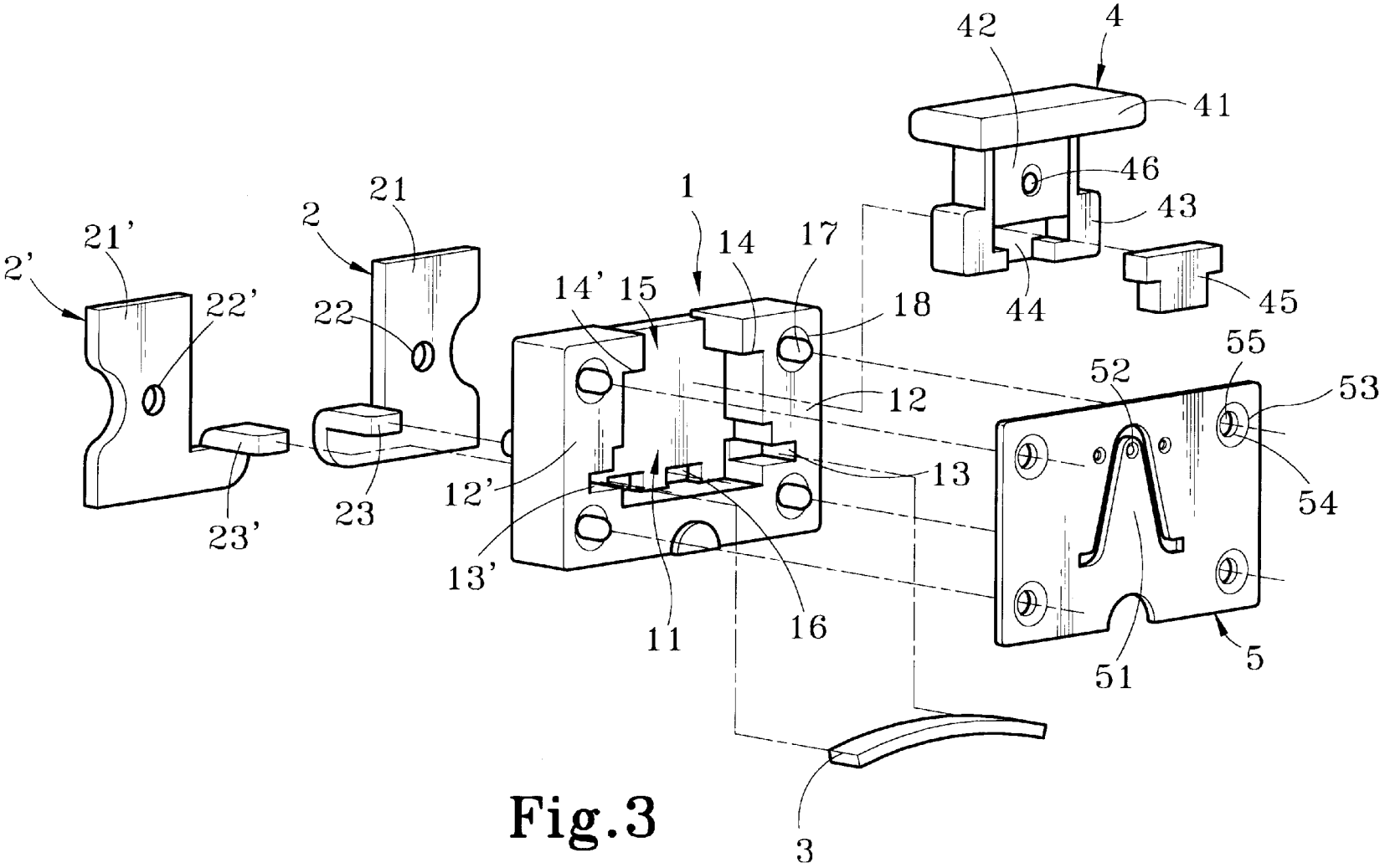
FIG. 3 is an exploded view of this invention.

Referring to FIGS. 2 and 3, the press switch according to this invention includes a body 1, two terminal element 2 and 2' mounted on the body 1, a first elastic element 3 located in the body 1, a press element 4 movably disposed in the body 1 above the first elastic element 3, and a face panel 5 for covering the body 1 at the front side thereof.

The body 1 has a compartment 11 for housing operation movement, two side walls 12 and 12' located at two lateral sides of the compartment 11, two slots 13 and 13' formed respectively in the side walls 12 and 12' communicating with the compartment 11, two stepwise flanges 14 and 14' formed respectively at one end of the side walls 12 and 12', and an opening 15 formed between the flanges 14 and 14' communicating with the compartment 11. The compartment 11 borders a rear wall of the body 1 which has two symmetrical through holes 16 formed therein. At the front side of the side walls 12 and 12', there are a plurality of cavities 17 formed respectively at two lateral sides thereof. Each cavity 17 has a protrusive stub 18 extended outward.

The terminal element 2 and 2' have respectively a plate 21 and 21' each has a fastening member 22 and 22' which can engage with the cavity 17 and the protrusive stub 18; and a contact finger 23 and 23' which may pass through the through holes 16 into the compartment 11.

Figure 4A:
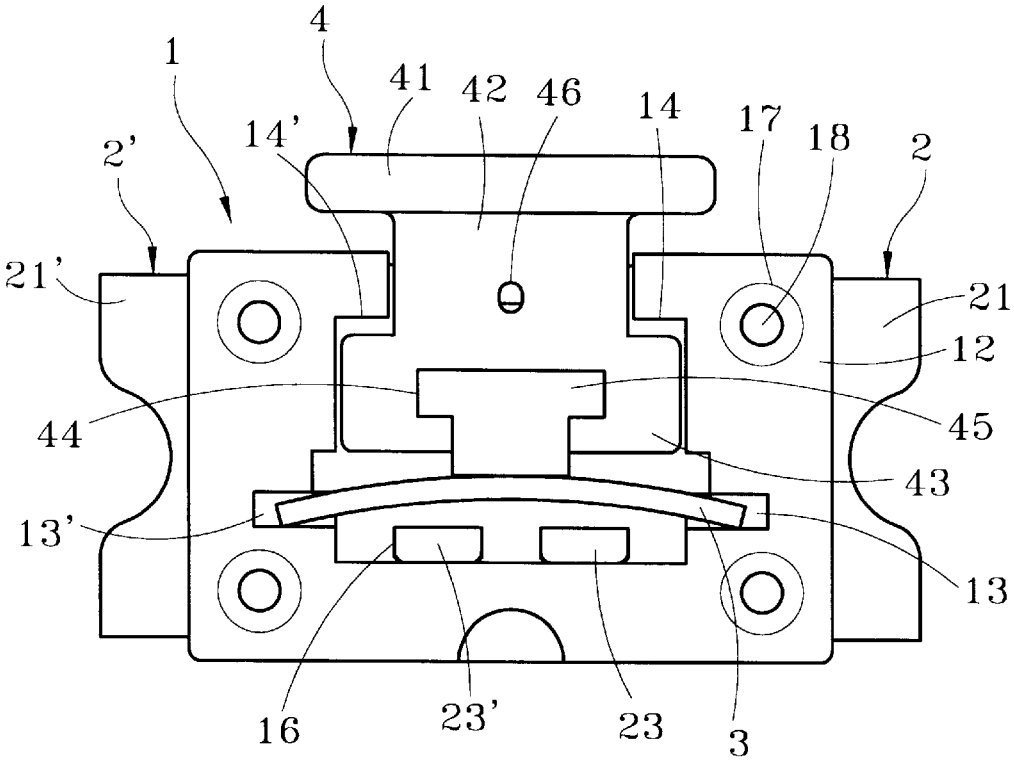
FIG. 4A is a front view of this invention, with the face panel detached.

The first elastic element 3 is made of an elastic metal and has two ends engageable with the slots 13 and 13' (also shown in FIG. 4A).

The press element 4 has a press head 41 at the top connecting with a neck section 42 located thereunder. The neck section 42 connects with two legs 43 located at two lateral sides which form a trough 44 therebetween. The trough 44 holds a second elastic element 45 therein. The second elastic element 45 is preferably made from rubber. After assembly, the second elastic element 45 is located above the first elastic element 3. When the press head 41 subjects to an external pressing force and moves the second elastic element 45 downward, the first elastic element 3 will also be pressed downward (referring to FIG. 4B). The front side of the neck section 42 further has a dimple 46 which is used for sensing the downward movement of the press element 4 (functional details will be explained later).

The face panel 5 has an elastic tongue plate 51 which has a bulged point 52 formed at the tip thereof mating against the dimple 46 when the press element 4 is moved down. At the periphery of the face panel 5, there are a plurality of fastening elements 53 each has a step ring 54 and a bore 55 formed therein for engaging with the cavity 17 and the stub 18.

Figure 4B:
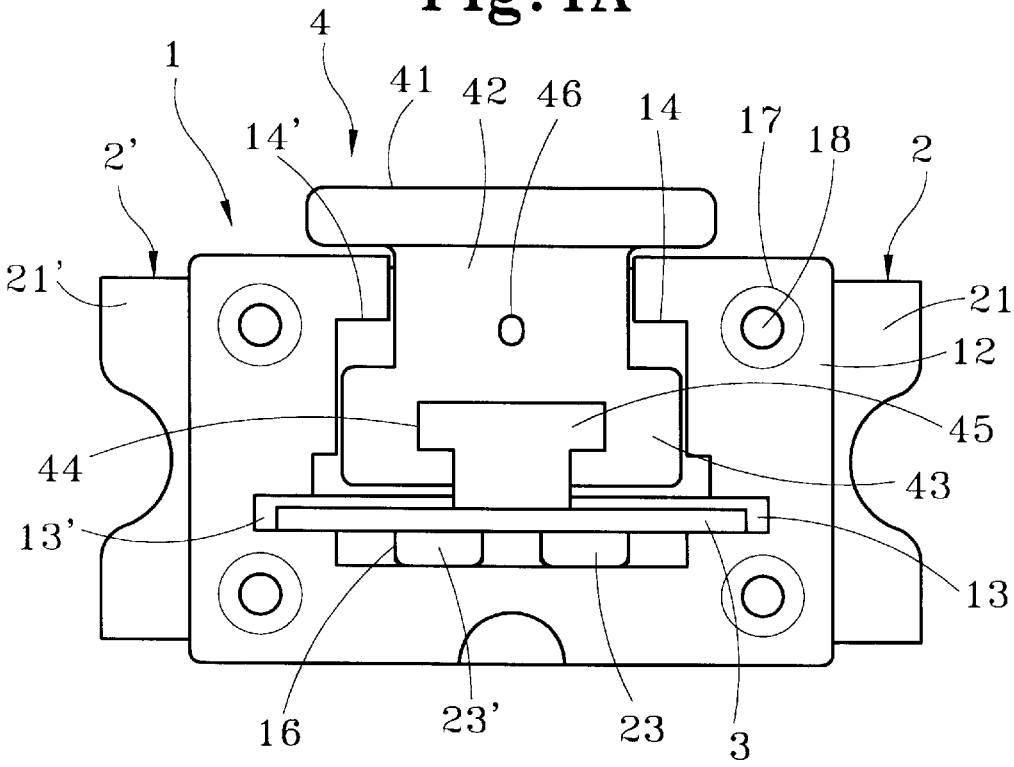
FIG. 4B is a front view according to FIG. 4A, showing this invention in use.

FIGS. 4A and 4B show this invention has been assembled for use. When the press head 41 receives an external pressing force, the neck section 42 will be moved downward through the opening 15. Consequently the second elastic element 45 will be moved downward and presses the first elastic element 3 downward. As a result, the first elastic element 3 will make contact with the contact fingers 23 and 23' (shown in FIG. 4B) thereby establish an electric conduction link to output electric characteristics. When the external pressing force is absent from the press head 41, the innate elastic force of the first and second elastic element 3 and 45 will push the press element 4 upward to its original position.

Figure 5:
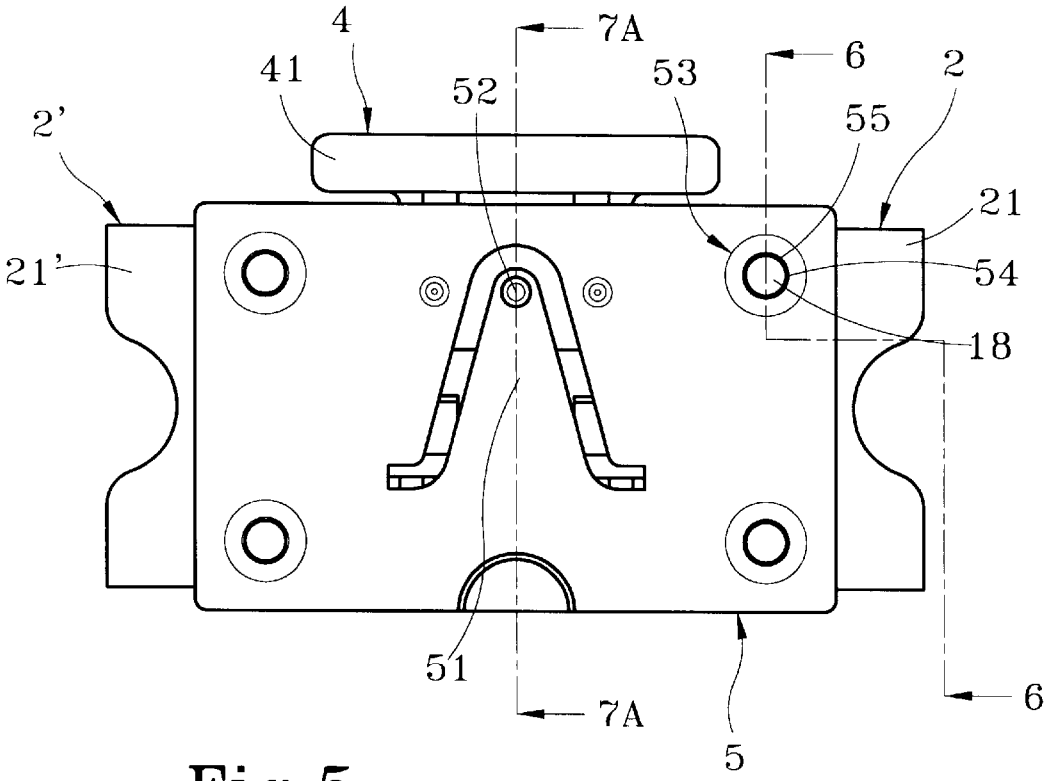
FIG. 5 is a front view of this invention, with the face panel assembled.
Figure 6:
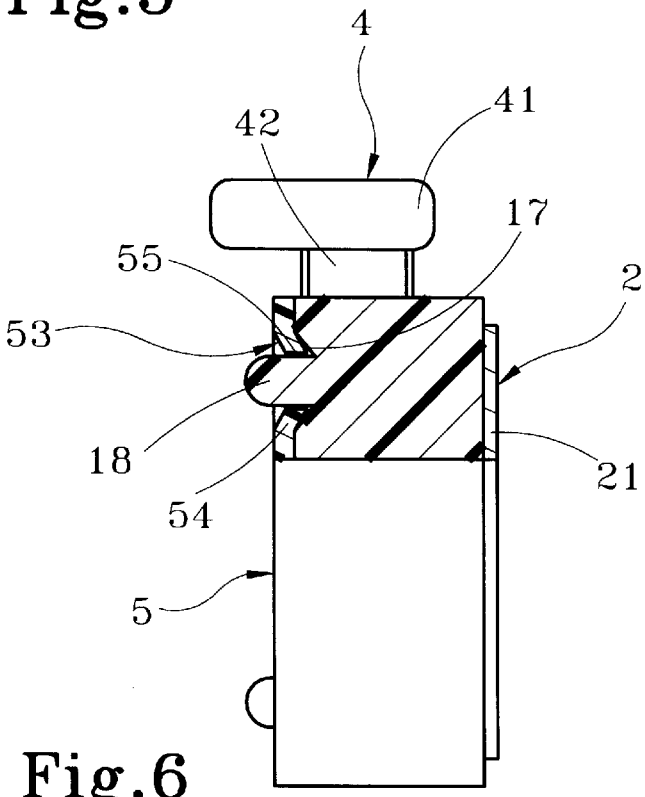
FIG. 6 is a sectional view of this invention taken along line 6—6 in FIG. 5.

Referring to FIGS. 5 and 6, when this invention is assembled completely, the face panel 5 is fastened to the body 1 at the front side thereof. This may be done by engaging the bores 55 with the stubs 18, and pressing the step ring 54 against the cavity 17 until reaching the bottom thereof to make the edge of the step ring 54 skew upward slightly for the bore 55 engaging with the stub 18 firmly and to have the free end of the stub 18 extended outside the front surface of the face panel 5 (shown in FIG. 6). Then heat melt the free end of the stubs 18 to fill the fastening elements 53 with melted resin for forming a firm and secured engagement between the body 1 and face panel 5. The fastening thus formed is tightly sealed without gap and may enhance electric characteristics output by the press switch.

Figure 7A:
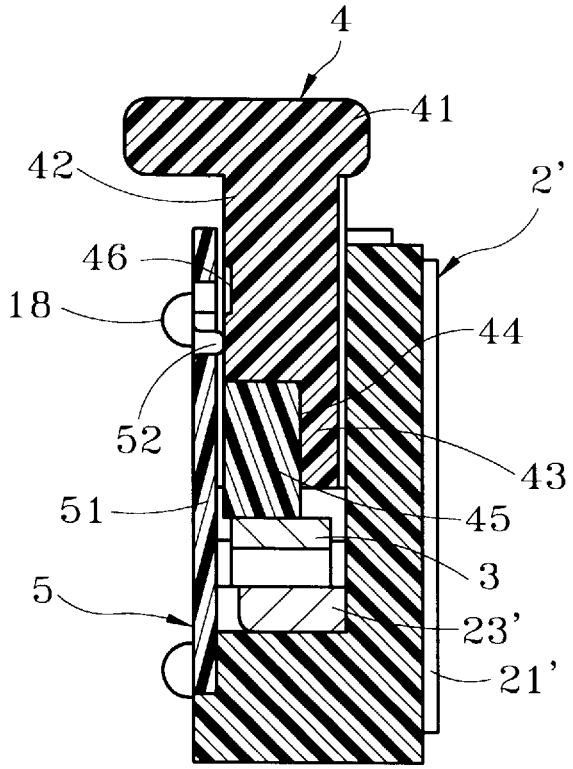
FIG. 7A is a sectional view of this invention taken along line 7A—7A in FIG. 5.
Figure 7B:
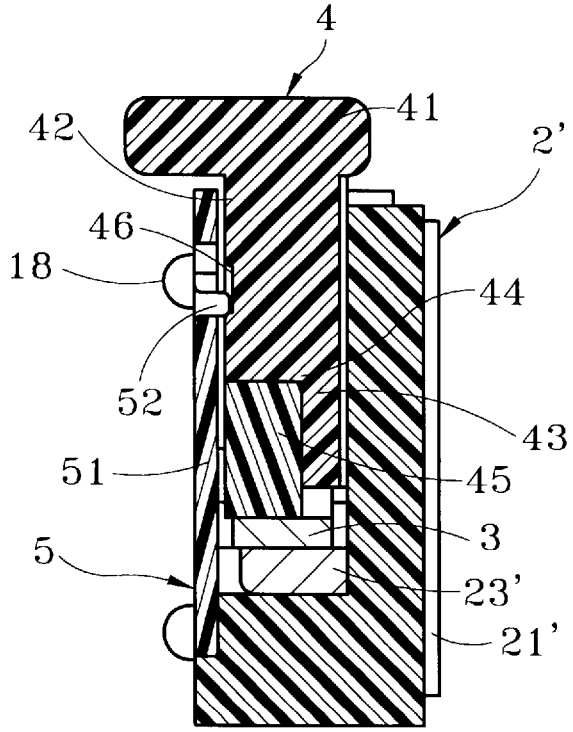
FIG. 7B is a sectional view according to FIG. 7A, showing this invention in use.

Referring to FIGS. 7A and 7B, when the press element 4 is pressed downward, the bulged point 52 at the elastic tongue plate 51 will slide on the front surface of the neck section 42, and will generate a click tremble or sound when reaching the dimple 46 (shown in FIG. 7B) whereby users may sense or. hear that the press switch has made electric contact. When the external pressing force is released, the press element 4 will be pushed upward to its original position by the innate elastic force of the first and second elastic element 3 and 45, and electric contact between the contact finger 23 and 23' will be cutoff (also shown in FIG. 4A).

The construction of this invention is simple, and may be assembled with less processes at a lower cost. Number of contact points is also less, and thus may greatly reduce impedance and may keep output signal from fading.

It may thus be seen that the objects of the present invention set forth herein, as well as those made apparent from the foregoing description, are efficiently attained. While the preferred embodiment of the invention has been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An improved press switch for channeling signal transmission or output, comprising:

a body including a compartment for housing operation movement, two side walls located at two lateral sides of the compartment, two slots formed respectively in the side walls communicating with the compartment, an opening formed at one end of the side walls communicating with the compartment and two symmetrical through holes formed in a rear wall bordering the compartment;

two terminal elements having respectively a plate each has a contact finger extended forward engageable with the through hole;

a first elastic element engageable with the slots; and a press element having a press head at the top end thereof which connects with a neck section located thereunder, the neck section connecting with two legs located at two lateral sides thereof and having a trough formed therebetween, the trough holding a second elastic element therein;

wherein the neck section will move downward through the opening when the press head subjects to an external pressing force such that the second elastic element will be moved downward to press the first elastic element to make contact with the contact fingers for establishing an electric link therebetween to output electric characteristics; then the innate elastic force of the first and second elastic elements will push the press element to an original position thereof when the external pressing force is released from the press head.

2. The improved press switch of claim 1, wherein the side walls further have respectively one end extended to form a stepwise flange.

3. The improved press switch of claim 1 or 2, wherein the side walls further have respectively a plurality of cavities formed thereon each having a protrusive stub located therein.

4. The improved press switch of claim 1, wherein the plates have respectively a fastening member.

5. The improved press switch of claim 1, wherein the neck section has a dimple formed thereon for sensing the downward movement of the press element.

6. The improved press switch of claim 1 further having a face panel.

7. The improved press switch of claim 6, wherein the face panel includes an elastic tongue plate which has a bulged point formed at the tip thereof, and a plurality of fastening elements located around the periphery thereof each has a step ring and a bore formed therein.

* * * * *